US005632076A

United States Patent [19]

Ervin et al.

[11] Patent Number: 5,632,076

[45] Date of Patent: May 27, 1997

[54] METHOD AND APPARATUS FOR GAPPING A CONTINUOUS ZIPPER CHAIN

[75] Inventors: James K. Ervin, Denver; Elijah Singleton, Gastonia, both of N.C.

[73] Assignee: Talon, Inc., Stanley, N.C.

[21] Appl. No.: 604,723

[22] Filed: Feb. 21, 1996

[51] Int. Cl.[6] ..... A41H 37/06; B21D 53/50

[52] U.S. Cl. ..... 29/408; 29/770; 83/921

[58] Field of Search ..... 29/408, 410, 769, 29/770, 33.2, 34 A; 83/921

[56] References Cited

U.S. PATENT DOCUMENTS

| | | | |
|---|---|---|---|
| 3,290,747 | 12/1966 | Burbank | 29/410 |
| 4,019,240 | 4/1977 | MacFee . | |
| 4,091,532 | 5/1978 | MacFee . | |
| 4,206,669 | 6/1980 | Fisher et al. . | |
| 4,236,293 | 12/1980 | Morita et al. . | |
| 4,242,785 | 1/1981 | Shimai . | |
| 4,325,185 | 4/1982 | Kanzaka . | |
| 4,604,783 | 8/1986 | Kojima et al. . | |
| 4,625,375 | 12/1986 | Osaki . | |
| 4,627,318 | 12/1986 | Hochlehnert et al. . | |
| 4,663,817 | 5/1987 | Samberg . | |
| 4,738,016 | 4/1988 | Samberg . | |
| 5,101,551 | 4/1992 | Rademacher et al. . | |
| 5,177,855 | 1/1993 | Shimai . | |
| 5,335,404 | 8/1994 | Ozaki et al. . | |

FOREIGN PATENT DOCUMENTS

| | | |
|---|---|---|
| 60142806 | 12/1983 | Japan . |
| 60142807 | 12/1983 | Japan . |
| 2041072 | 9/1980 | United Kingdom . |

*Primary Examiner*—P. W. Echols

*Attorney, Agent, or Firm*—Bell, Seltzer, Park & Gibson, P.A.

[57] ABSTRACT

An apparatus for gapping a zipper having a pair of slide fasteners stringers such that each fastener stringer has a continuous row of fastener elements secured to an edge thereof. The apparatus includes a support which has a substantially flat surface for supporting the stringers in a generally parallel alignment. An indexing wheel having a plurality of serrations located along a periphery thereof cooperates with the support to engage the fastener elements of each of the pair of fastener stringers for incrementally advancing the pair of fastener stringers a predetermined distance along the support. The hinged block is connected to the support. The hinged block is a pair of grooves formed along the surface thereof so as to be positioned in a path of the advancing fastener stringers for respectively receiving the fastener stringers in the area to be gapped. The hinged block is pivotable relative to the supports so that the fastener elements positioned in the pair of grooves of the hinged block are removed seriatim from each of the pair of fastener stringers and thereby form a gap in the slide fastener stringers in the region where the fastener elements are removed.

24 Claims, 8 Drawing Sheets

METHOD AND APPARATUS FOR GAPPING A CONTINUOUS ZIPPER CHAIN

FIELD OF THE INVENTION

The invention relates to a method and apparatus for gapping a continuous zipper chain and, more particularly, a method and apparatus for removing fastener elements from a pair of fastener stringers seriatim so that the zipper chain may later be cut at the gapped locations and a slider and ends stops added thereto to produce a zipper of predetermined length.

BACKGROUND OF THE INVENTION

Zippers are typically mass-produced using two parallel stringers whose facing edges each carry plastic fastener elements that are interlocked together. In order to obtain zippers of the desired length, the fastener stringers are introduced into a device which forms gaps of predetermined length at predetermined locations within the fastener stringers.

Typically such fasteners are mass produced in a manner similar to that disclosed in commonly assigned U.S. Pat. No. 4,932,113. The operation usually begins with a workpiece comprised of two long parallel fastener tapes or stringers whose facing edges each carry a number of plastic fastener elements that are joined i.e., interlocked together. The workpiece is fed into a first machine which removes the joined elements from a predetermined distance at spaced locations on the workpiece to form a series of gaps therein.

Bottom stops are then fitted onto each of the fastener stringers adjacent the first fastener element. Thereafter, a slider is fitted to the fastener elements from the lead edge of each gap so as to separate the fastener elements. Top stops are then applied to an end opposite the bottom stops. Finally, the fastener stringers are generally transversely cut in the approximate center of the gap to separate the fasteners of predetermined length corresponding to the location of the gaps.

Traditionally gaps are formed in the fastener elements by a gapping machine having a transport system in the form of pinch rollers which pulls or advances the workpiece through a guide provided at the upstream end. Downstream thereof is a punch and die system which serves to cut the fastener elements from each of the respective fastener stringers. When the workpiece has been positioned adjacent the punch and die, a clamp located at or adjacent to the area to be gapped is temporarily closed and a cutter works to remove some or all of the fastener elements through a predetermined length. Examples of such an approach to forming gaps in a workpiece may be found in U.S. Pat. Nos.: 5,334,404; 5,177,855; 5,101,551; 4,738,016; 4,663,817; 4,627,318; 4,625,375; 4,604,783; 4,242,785; and 4,206,669.

Subsequently, a new approach for forming gaps in a workpiece was developed by Applicant in commonly assigned U.S. Pat. Nos. 4,091,532 and 4,019,240 which are hereby incorporated by reference. These patents disclose the use of a gapping machine which provides a clamp which clamps the opposite sides of the portion of the stringer to be gapped, and a hinged block which pivots relative to the clamped fastener stringers to pull off or remove seriatim a plurality of the fastening elements in the area to be gapped. Variations of this approach may be found in U.S. Pat. Nos. 4,325,185 and 4,236,293, Japanese Patent Nos. 60-142,806 and 60-142,807, and U.K. Patent Application No. 2,041,072.

Regardless of which approach is used to form the gaps, it is important to obtain gaps of uniform length. Several methods have developed to obtain gaps of uniform length. One approach has been to use a counter to determine the location of the preceding gap. For example, U.S. Pat. Nos. 4,019,240 and 4,091,532 commonly assigned to Applicant, disclose a gapper device having a fastener chain gap sensing device positioned downstream from the gapper at a predetermined distance corresponding to the desired distance between gaps. The device includes a pivotally mounted lever which is spring biased so as to urge a tip of the lever into engagement with the fastener elements being pulled through the gapper machine and a micro switch operably connected thereto. When the lever senses a gap, the lever pivots to operate the switch to initiate another gapping cycle.

An alternative approach has been to rely on some form of a detection roller or measuring wheel which cooperate with a sensor or counter to determine the distance between gaps. Examples of such an approach is disclosed in U.S. Pat. No. 5,335,404 to Osaki et al., U.S. Pat. No. 5,177,855 to Shimai, U.S. Pat. No. 5,101,551 to Rademacher et al., U.S. Pat. No. 4,625,375 to Osaki, and U.S. Pat. No. 4,604,783 to Kojima et al. Unfortunately, by relying on any of the above disclosed approaches to determine the distance between gaps still requires the use of additional equipment to actually advance the fastener stringers to the predetermined location.

Another area of concern in forming gaps is to prevent damage to the fastener elements immediately adjacent the upstream and downstream ends of the gap. If either the upstream or downstream fastener elements are damaged during gapping, then an extra step is required during the manufacturing process to remove these partial fastener elements prior to applying the top and bottom stops.

One approach to ensuring that the fastener elements immediately adjacent the gap to be formed will not be damaged is disclosed in U.S. Pat. No. 5,335,404 to Osaki et al. which uses a pair of positioning pins located on the upstream and downstream side of the cutting unit. Each positioning pin has an approach sensor for detecting whether or not the distal end of the positioning pin has been inserted between adjacent fastener elements. A selectively rotatable drive motor is moved either forward or backward to ensure that the positioning pins are correctly inserted between fastener elements.

U.S. Pat. No. 4,627,318 to Hochlehnert et al. discloses another approach to solving this problem. The Hochlehnert et al. gapper device has a pair of spring mounted grippers, each having a pin extending therefrom to be positioned between adjacent fastener elements. If a pin lands directly atop a fastener element, the springs of the grippers will cause the grippers outward movement until the pin is properly positioned. The consequence of using any of the above-described approaches to avoid damaging the upstream and downstream fastener elements requires the addition of expensive and complicated locating and/or positioning equipment which not only increases the cost of product but also may result in additional production time to reposition the workpiece.

In conjunction with the need to ensure gaps of uniform length and the need to avoid damaging the upstream and downstream fastener elements of each gap, it is important to be able to readily adjust the gapper device to accommodate gaps of varying lengths and accommodate fastener stringers of different gauges. This is especially true in today's demanding manufacturing climate where production runs of a particular type and gauge of zipper changes frequently, often several times during a single production day. The ability to quickly adjust the gapper device to a different gap length and/or a different gauge i.e., size of zipper is important to minimizing waste material and downtime.

SUMMARY OF THE INVENTION

In view of the foregoing background, it is therefore an object of the present invention to provide a gapper device which efficiently and cost effectively determines the location between gaps, ensures that the upstream and downstream fastener elements immediately adjacent the gap will not be damaged during gapping, and is readily adaptable to accommodate gaps of different lengths and fastener stringers of different gauges.

These and other objects, features and advantages of the present invention are obtained by providing an apparatus for gapping a zipper having a pair of slide fastener stringers such that each fastener stringer has a continuous row of fastener elements secured to an edge thereof. The apparatus includes a support having a substantially flat surface for supporting the pair of fastener elements thereon in generally parallel alignment. An indexing wheel is provided which cooperates with the support. Preferably, the indexing wheel has a plurality of serrations located along a periphery thereof for engaging the fastener elements of the pair of fastener stringers and for preferably incrementally advancing the pair of fastener stringers a predetermined distance along the support. A hinged block is beneficially connected to the support upstream of the indexing wheel. Preferably, the hinged block has a pair of grooves formed along a surface thereof and positioned in the path of the advancing fastener stringers for respectively receiving the fastener stringers in at least the area to be gapped. A pivoting means for pivoting of the hinged block relative to the support is advantageously provided so that the fastener elements positioned in the pair of grooves of the hinged block are removed seriatim from each of the pair of fastener stringers to thereby form a gap in the slide fastener stringers in the region where the fastener elements are removed.

Preferably the hinged block has a locator which is movably connected thereto for being positioned between adjacent fastener elements on the respective fastener stringers to ensure that the downstream end of the gap is properly located.

By providing a locator integrally connected and collectively movable relative to the hinged block so as to be positioned between adjacent fastener elements enables the fastener stringers to be gapped so as to ensure that the fastener elements immediately adjacent a formed gap are undamaged and have an opposed relationship to thereby obtain gaps of uniform size. To assist in obtaining uniformly sized gaps, it is beneficial to provide a punch which is connected to the hinged block. Preferably the punch removes at least one and preferably the first two fastener elements from the upstream end of the gap to be formed prior to any movement of the hinged block.

As is readily understood by those skilled in the art to which the invention relates, the cooperation between the indexing wheel and stepper motor for adjustably controlling the incremental rotation of the indexing wheel enables finite control over the advancement of the pair of fastener stringers.

The ability of the gapper device to accommodate an indexing wheel which is one of a set of interchangeable indexing wheels, in conjunction with a hinged block which is one of a set of correspondingly interchangeable hinged blocks enables the device to accommodate a large variety of gauges of fastener stringers, obtain a large variety of predetermined sized gaps to be formed therein, and allows the predetermined distance between gaps to be varied as desired. The ability to perform each of these adjustments is made much easier by use of a computer controller.

An acceptable method of gapping a zipper having a pair of fastener stringers each having a continuous row of fastener elements secured to an edge thereof includes guiding each of the respective fastener stringers into corresponding grooves formed in a hinged block in at least the area to be gapped. Thereafter, engaging the fastener elements of the pair of fastener stringers by an indexing wheel having a plurality serrations located in spaced relation around a periphery thereof. The pair of fastener stringers are then incrementally advanced with the indexing wheel a predetermined distance along the support so as to position the fastener stringers into grooves of the hinged block. A locator connected to the hinged block Is then preferably positioned between adjacent fastener elements to locate the pair of fastener stringers in a predetermined position relative to the hinged block. Once the locator has been positioned, the hinged block is pivoted relative to the support so that the fastener elements are moved seriatim from each of the pair of fastener stringers so as to insure that the fastener elements immediately adjacent a formed gap are undamaged and have an opposed relationship.

It is beneficial for obtaining a gap of uniform size with the desired opposed relationship of the upstream and downstream fastener elements immediately adjacent the gap to be formed to provide a punch for removing at least one and preferably the two upstream fastener elements of the gap prior to the pivotal movement of the hinged block.

Preferably, prior to being gapped, the pair of fastener stringers are separated from interengagement with one another prior to being guided into the hinged block. Ideally, a portion of each of the pair of fastener stringers is clamped to the support adjacent the hinged block to prevent movement of the fastener stringers as they are being gapped.

BRIEF DESCRIPTION OF THE DRAWINGS

Some of the objects, features and advantages of the present invention having been stated, others will appear as the description proceeds, when taken in conjunction with the accompanying drawings in which;

FIG. 2*a* is a top perspective view of a portion of a pair of slide fasteners having a gap formed therein;

DETAILED DESCRIPTION OF THE PREFERRED EMBODIMENTS

The present invention will now be described more fully hereinafter with reference to the accompanying drawings, in which the preferred embodiment of the invention is shown. This invention may, however, be embodied in different forms and should not be construed as limited to the embodiments set forth herein. Rather, the illustrative embodiment is provided so that this disclosure will be thorough and complete, and will fully convey the scope of the invention to those skilled in the art. Like numbers refer to like elements throughout.

Figure 1:
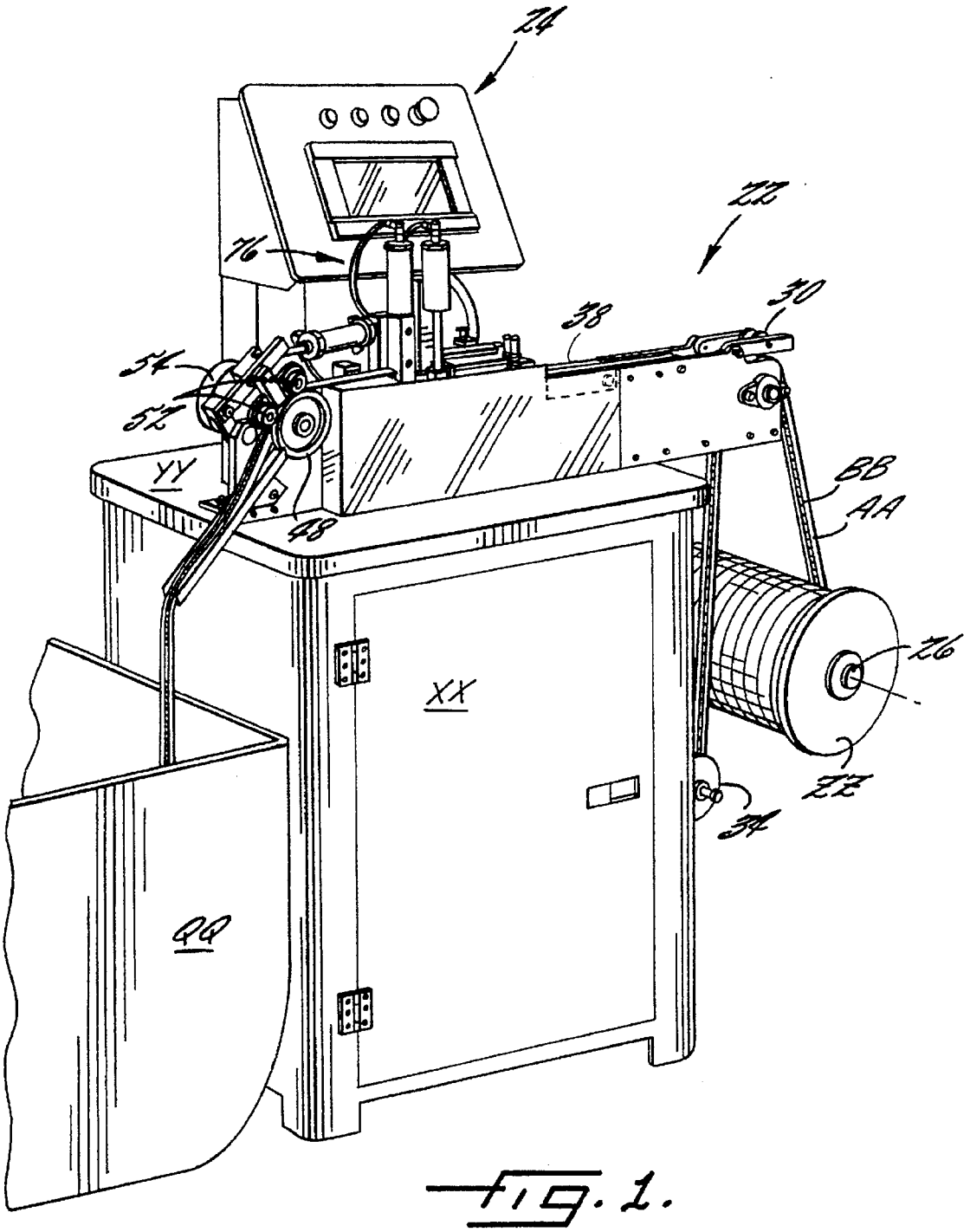
FIG. 1 is a side view in perspective showing the device in accordance with the present invention.
Figure 2:
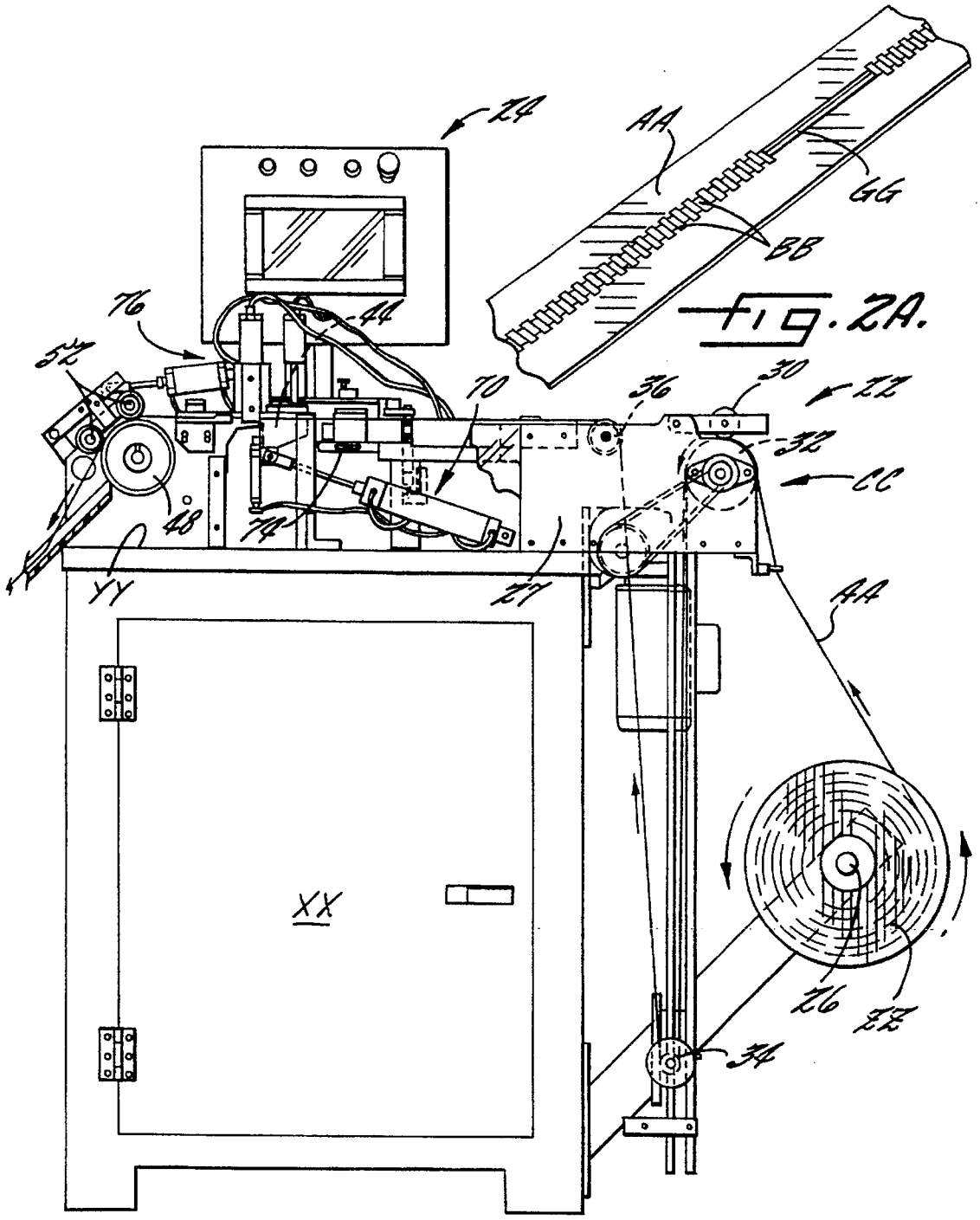
FIG. 2 is a side view partially in phantom showing the individual elements of the device.

As shown in FIGS. 1 and 2, in accordance with the present embodiment, a gapper device, generally indicated as 22, is positioned on a stand such as a cabinet XX having a generally planar surface YY. The gapper device 22, in the embodiment shown, includes a cover 27 which protects the internal components of the device from the surrounding environment. A portion of the cover is metal and a portion thereof is transparent to allow the operator to monitor the operation of the device.

A spool ZZ of slide fastener stringers AA, each having a plurality of fastener elements BB attached to respective edges thereof and arranged in interlocking fashion, is rotatably mounted to a removable spindle 26. The spindle 26 is mounted to a support arm 28 in turn connected to the stand XX. A first tension roller 30 and a first puller wheel 32 are positioned at an upstream end CC of the gapper device 22 in frictional engagement with each other to controllably advance the fastener stringers AA from the spool ZZ.

The fastener stringers AA then travel past a movable tension roller 34, which travels vertically relative to the longitudinal axis of the gapper device 22 to control the tension of the fastener stringers AA as they advance toward the upstream end CC of the gapper device. The fastener stringers AA then travel over another roller 36 and onto a support 38 of the gapper device 22. The support 38 has a generally flat surface which supports the fastener stringers AA so as to allow the fastener stringers to lay flat thereon as they are advanced downstream.

Figures 3, 3A, 3B:
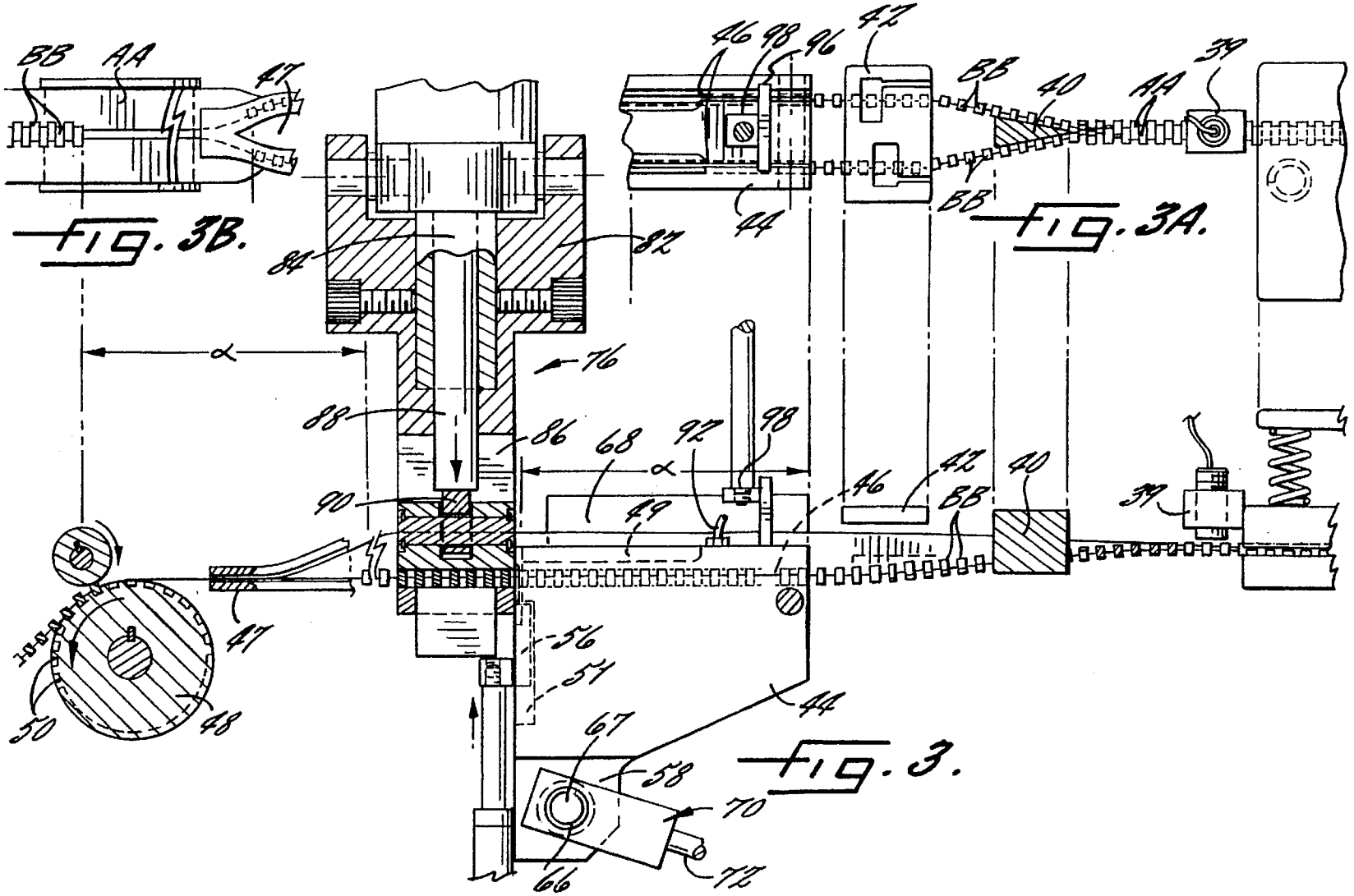
FIG. 3 is a side view partially and cross-sectioned of a portion of the device showing the hinged block in the neutral position.
FIG. 3*a* is a top plan view of a portion of the device upstream of the clamping device as shown in FIG. 3.
FIG. 3*b* is a top plan view of a portion of the device shown in FIG. 3 located downstream of the clamping device as shown in FIG. 3.

As best shown in FIGS. 3 and 3A, a splice detector 39, is electronically connected to a computer controller, generally indicated as 24 which, in this embodiment, controls operation of the gapper device 22. The splice detector 39, in this case a proximity probe, is used to measure the distance between the detector and the fastener stringers AA against a predetermined distance. If the splice detector 39 detects a distance greater than the predetermined distance programmed therein, a signal is sent to the computer controller 24, which in turn sends a shut-off signal to gapper device. The purpose of the splice detector 39 is to detect splices between subsequent fastener stringers AA to ensure that the gapper device recognizes the beginning of the next fastener stringers so that the next gap to be formed is properly located relative to the lead end of the next fastener stringers. In addition, if the splice detector 39 identifies stringer fasteners AA which are not lying flat, a signal is sent to stop the gapper device 22. Consequently, the splice detector 39 assists in maintaining a high standard of quality.

A chain splitter 40, in this case a slider, is located downstream of the splice detector 39, in the path of the advancing fastener stringers AA, so as to separate the fastener elements BB of each of the fastener stringers from interengagement and to simultaneously rotate each of the fastener stringers AA to an inverted position. Once inverted, the fastener stringers AA are advanced through a sensor 42 which senses movement of the fastener elements of the respective fastener stringers. If the sensor 42 does not detect movement after two tries, a signal is sent to the computer controller 24 to shut down the gapper device 22. By so doing, the sensor 42 helps prevent any damage to the gapper device 22.

The hinged block 44, when in a first generally horizontal position shown in FIGS. 2, 3, 3A, and 9, is located in the path of the oncoming fastener stringers AA. A pair of grooves 46 are formed in the hinged block 44 along the longitudinal axis thereof, i.e., in the upstream and downstream direction, so as to receive fastener elements BB of the respective fastener stringers AA, in at least the area to be gapped. As shown, the fastener elements BB of the respective fastener stringers AA pass through the grooves 46 of the hinged block 42 until the predetermined location of the gap GG to be formed is located.

Figure 8:
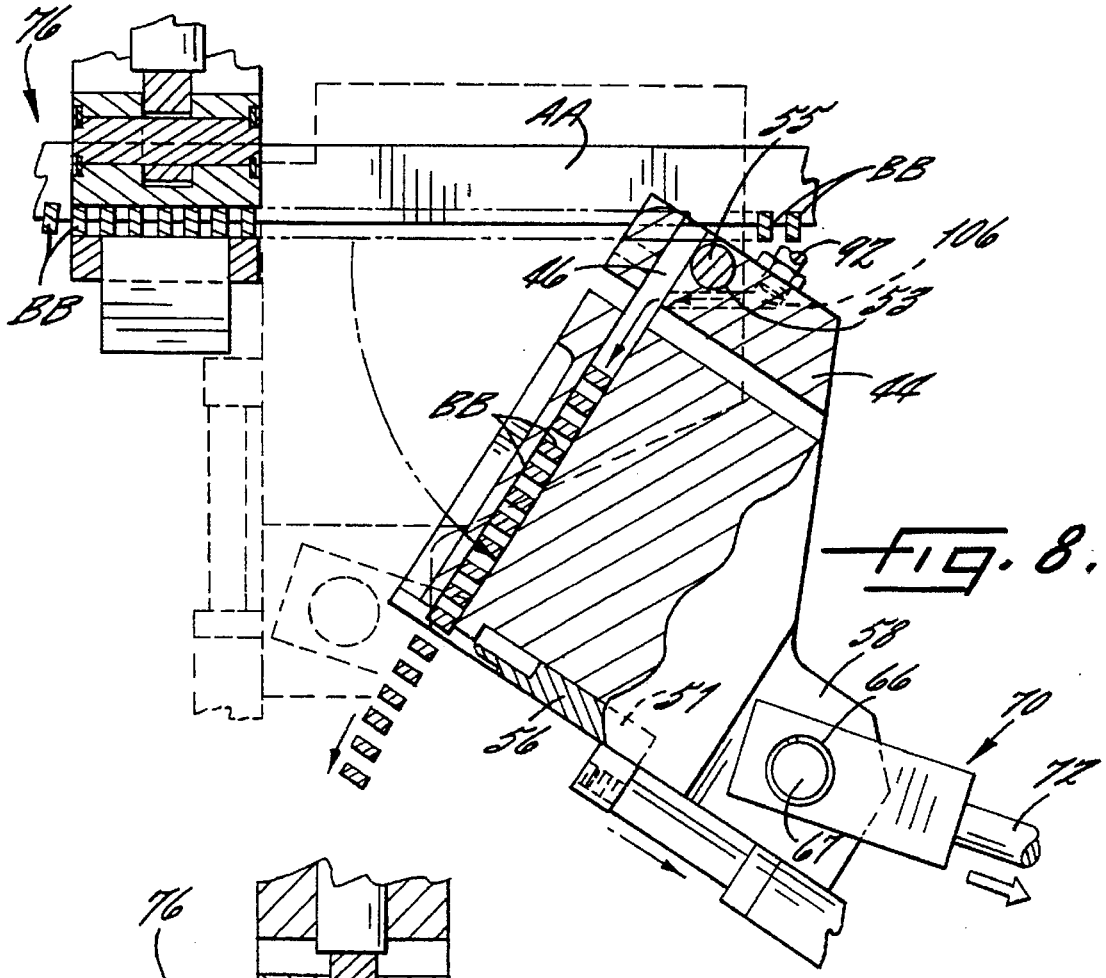
FIG. 8 is a side view partially and cross-sectioned of the device in the area of the hinged block illustrating the pivotal movement of the hinged block relative to the support.
Figure 9:
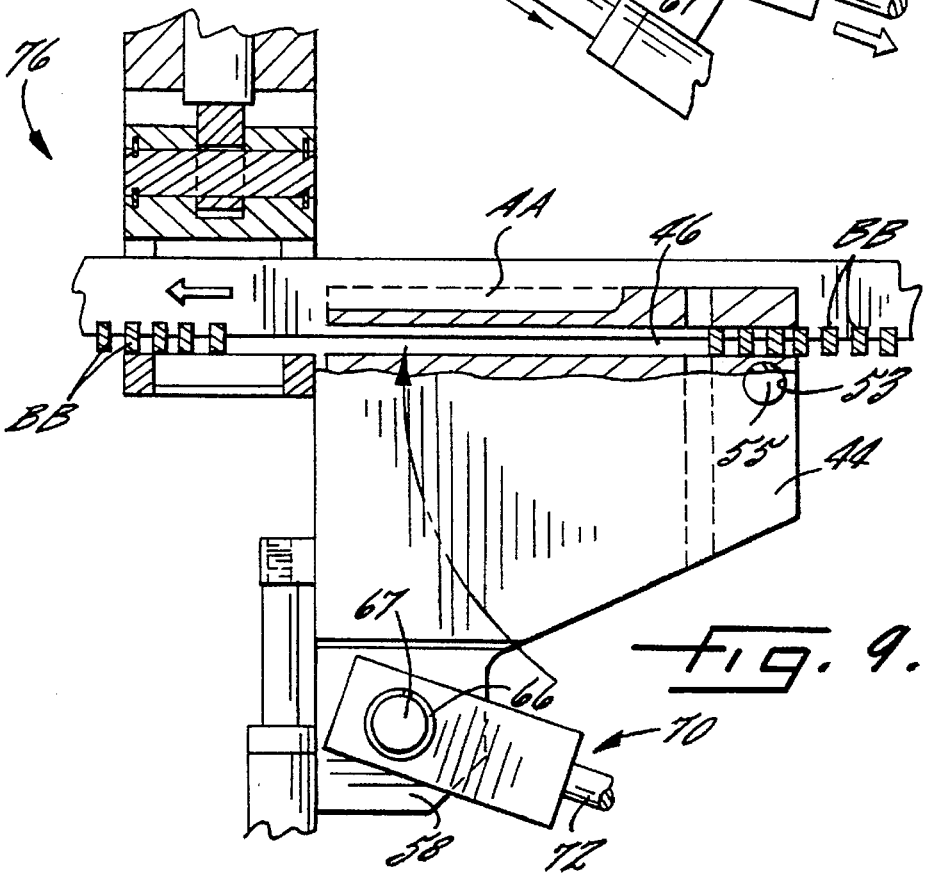
FIG. 9 is a side view partially and cross-sectioned of the device in the area of the hinged block cylinder that is illustrated in FIG. 8 showing the hinged block in a neutral position for receiving the fastener elements of advancing fastener stringers.
Figure 11:
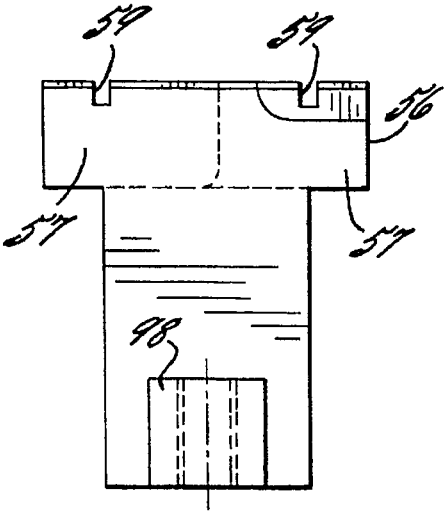
FIG. 11 is a side view of the locator illustrated in FIG. 10.
Figure 10:
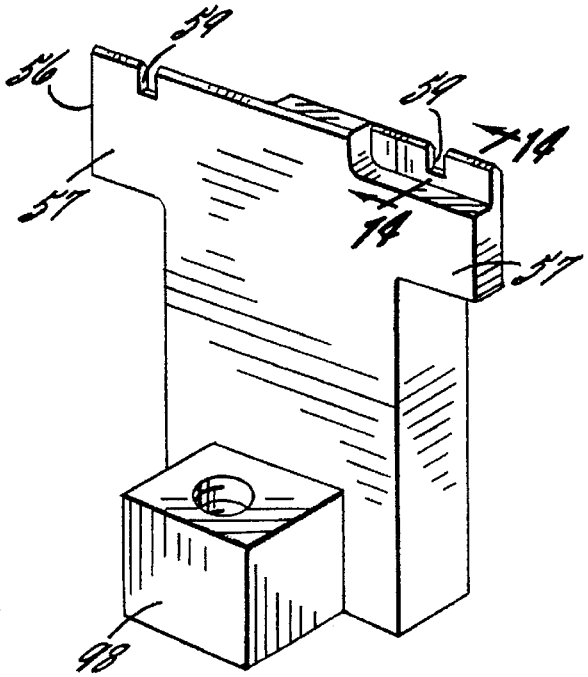
FIG. 10 is a side view in perspective of the locator.
Figure 12:
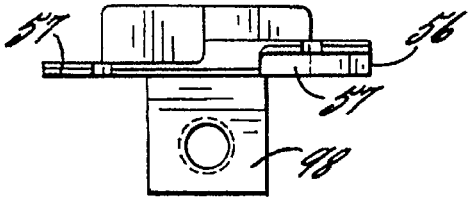
FIG. 12 is a top plan view of the locator illustrated in FIG. 11.
Figure 13:
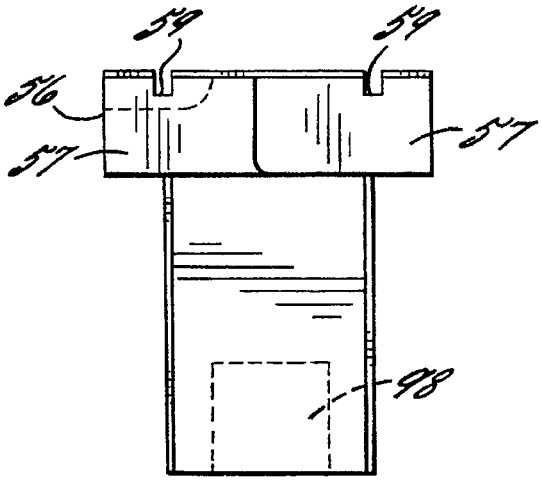
FIG. 13 is an opposite side view of the locator illustrated in FIG. 11.
Figure 14:
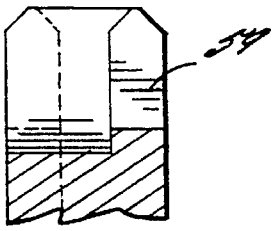
FIG. 14 is a side view partially and cross-sectioned taken along the lines 14—14 of FIG. 10.

As best shown in FIGS. 15 through 18, the hinged block 44 has a generally rectangular configuration when seen in side view. An upstream portion of the hinged block is angled to provide additional clearance for the hinged block when it has been pivoted downward to a second position, shown in FIG. 8, angularly displaced from the first position. When seen in side view, the two ends of the hinged block 44 are generally parallel and generally transverse to the longitudinal axis of the hinged block. Each of the grooves 46 formed in an upper surface of the hinged block 44 contain an angled notch portion 49 extending from approximately a midpoint of the hinged block to the downstream end thereof. The length of the notch portion 49 corresponds to the size of the gap GG to be formed in the fastener stringers AA. A recessed area 51 is located at the downstream end of the hinged block 44. The shape of the recessed area 51 corresponds to the shape of a locator 56 movably positioned therein.

An attachment bracket 58 is integrally formed with a center portion 60 of the hinged block 44. The attachment bracket 58 includes an angled transition position 59 which ensures the fastener elements BB which have been removed from the fastener stringers AA do not get trapped within the hinged block 44. A pair of fasteners 62, such as bolts, secure the center portion 60 and two side portions 64*a* and 64*b* together to form the hinged block 44. The attachment bracket 58 defines an opening having a bearing 66 positioned therein. A cotter pin 67, or the like, is removably fitted into the bearing 66 to connect the hinged block 44 to an air cylinder, generally indicated as 70 while allowing easy removal thereof. The hinged block 44 also includes a pair of upwardly extending flanges 68.

Figure 15:
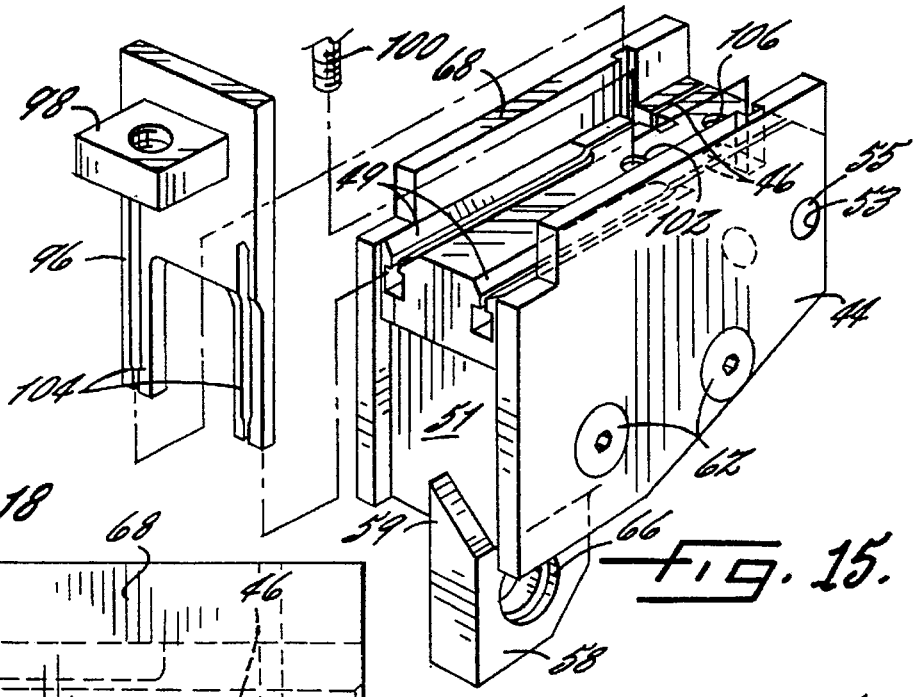
FIG. 15 is a side view in perspective of the hinged block illustrated in FIG. 9.
Figure 16:
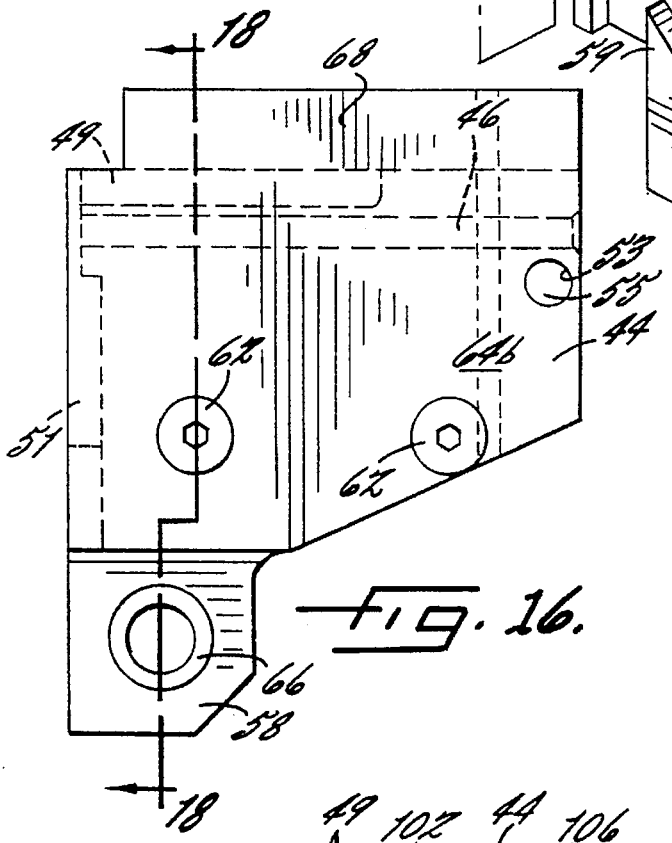
FIG. 16 is a side view partially in phantom of the hinged block illustrated in FIG. 15.
Figure 18:
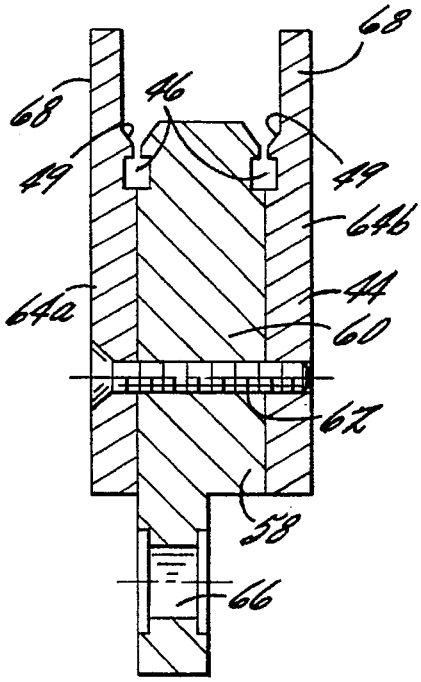
FIG. 18 is an end view partially and cross-sectioned taken along lines 18—18 of FIG. 16.
Figure 17:
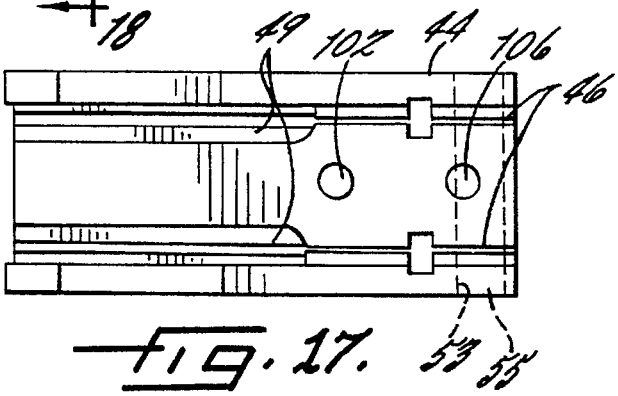
FIG. 17 is a top plan view of the hinged block illustrated in FIG. 15.

A pair of vertical grooves 94 are formed in the flanges 68 adjacent the upstream end of the hinged block 44. The vertical grooves 94 are adapted to receive a punch 96, which is spring biased in an up position when viewed in FIG. 15. The punch 96 is attached to the hinged block 44 by means of a shoulder bolt 98 and a threaded fastener 100 which fits in a corresponding threaded opening 102 formed in the hinged block. As discussed below in greater detail, an air cylinder (not shown) moves the punch 96 downward to overcome the spring bias. As shown in FIG. 15, the punch has a pair of tines 104 corresponding to each of the pair of grooves 46 through which the fastener elements BB are advanced. The hinged block 44 also contains a plurality of air apertures 106, the purpose of which will be discussed in detail below. A bore 53 is defined in an end opposite the recessed area 51. A pivot pin 55 is positioned within the bore 53 and pivotally connects the hinged block 44 to the support One end of the air cylinder 70, is pivotally connected to the bearing 66 of the hinged block 44 and a second end is fixedly connected to the support 38. The cylinder 70 in this embodiment is controllably operated by air pressure. The gapper device 22 includes a central air source (not shown) with individual valves for controlling each of the air cylinders described herein. It is to be understood however that other conventional means of operating the cylinders are available without departing from the spirit of the invention. A reciprocating piston 72 of the cylinder 70 moves relative to the remainder of the cylinder in order to pivot the hinged block 44 between the first position and the second position. As shown in FIG. 2, an adjustable stop 74 is provided to stop the downward travel of the hinged block 44 to thereby prevent the piston 72 from bottoming out i.e., traveling the full length of the cylinder.

Figure 19:
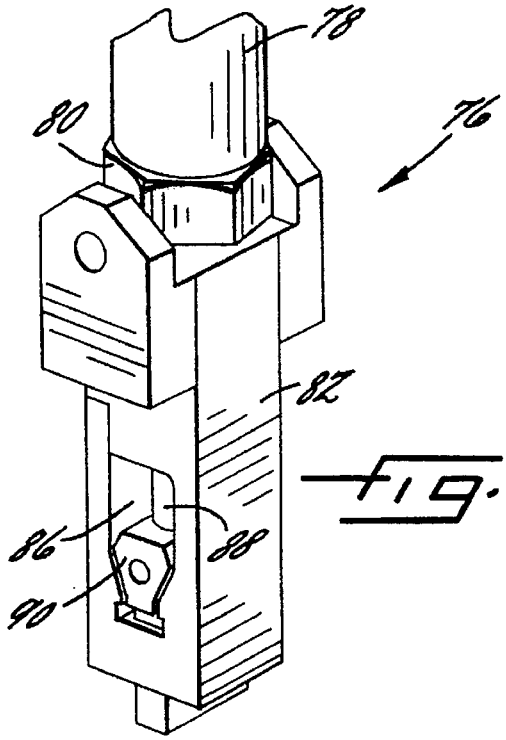
FIG. 19 is a side view in perspective of a portion of the clamping device shown in FIG. 2.
Figure 20:
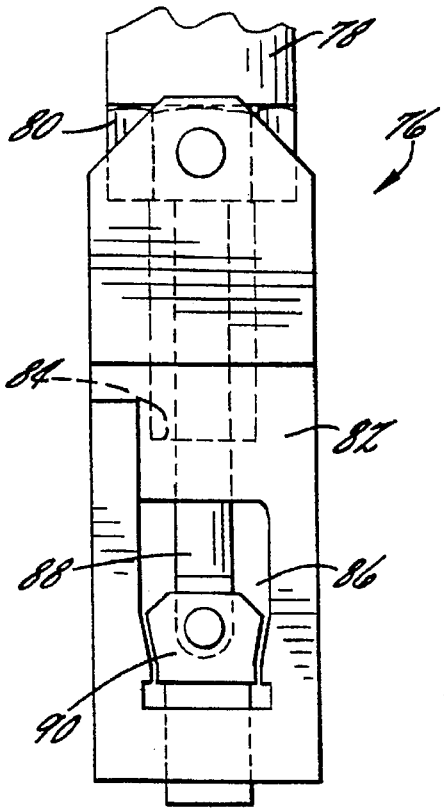
FIG. 20 is a side view partially in phantom of the clamping device illustrated in FIG. 19.
Figure 21:
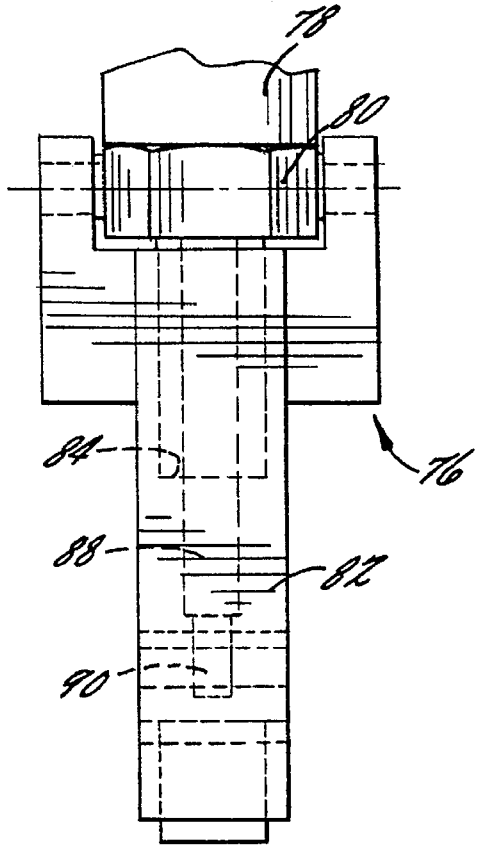
FIG. 21 is a side view partially in phantom of a transverse face of the clamping device illustrated in FIG. 19.

As best shown in FIGS. 19 through 21, a clamping device, generally indicated as 76 is positioned adjacent to and downstream from the hinged block 44. The purpose of the clamping device 76 is to clamp a portion of the fastener stringers AA in the area of the hinged block 44 to assist in locating the gap to be formed and ensure that the fastener stringers are taught when the hinged block moves from the first position shown in FIG. 9 to the second position shown in FIG. 8.

The clamping device 76 is connected to the support 38 in an orientation generally transverse to the direction of travel of the advancing fastener stringers AA. The clamping device 76 has an upper portion comprising an air cylinder 78 connected to the main air supply by a valve (not shown). In turn, the valve (as are all valves of the gapper device 22) is controlled by the computer controller 24. A fastener 80, in this instance a threaded bolt secures the air cylinder 78 to a housing 82 having an upper end configured to receive the threaded bolt and the air cylinder. The housing 82 has a generally rectangular configuration and defines a bore 84 generally centrally located along its longitudinal axis. The housing 82 further defines an opening 86 which is shaped to accommodate reciprocal movement of a piston 88 of the air cylinder 78 and a clamp 90 attached to a free end of the piston.

Once the fastener stringers AA have been advanced the predetermined amount, the computer controller 24 activates the appropriate valve for the air cylinder 78 of the clamping device 76 so as to cause the piston 88 thereof and the clamp 90 attached thereto to move within the bore toward the fastener stringer to be clamped. As is readily understood and contemplated by this invention, there may be one or more clamping devices 76 used with the gapper device 22 to clamp one or both fastener stringers AA in one or more locations relative to the hinged block. Additional information regarding the clamping device may be found in U.S. Pat. Nos. 4,091,532 and 4,019,240.

An indexing wheel 48 is positioned downstream of the hinged block 44. The indexing wheel 48 is attached to the support 38 so as to have a peripheral surface of the indexing wheel in general horizontal alignment with the support. As may be seen in FIG. 3, the indexing wheel 48 has a plurality of serrations 50 located along a periphery thereof. The serrations 50 are spaced from one another a distance corresponding to the distance between adjacent fastener elements BB of each of the respective fastener stringers AA. This distance between adjacent fastener elements BB is dependant upon the gauge of the fastener stringers AA.

In the embodiment shown in FIGS. 1 and 2, there are a pair of tensioning rollers 52 which cooperate with the indexing wheel 48. It should be understood that a single tension roller may also be used to provide the necessary pressure. The tension rollers 52 place sufficient downward pressure on the fastener stringers AA to ensure that there is limited slack in the fastener stringers as they advance and assist the indexing wheel to ensure that the fastener stringers are advanced the desired amount. This desired amount is predetermined and programmed into the computer controller 24 by the operator based upon a multitude of factors such as the gauge of the fastener stringers AA, the intended use of the finished zipper, etc.

A stepper motor 54 attached to the indexing wheel 48 controls the rotation of the indexing wheel. In this embodiment, the stepper motor 54 has a pitch displacement such that each pulse is equal to 0.0125 inch. The pitch displacement of the stepper motor 54, corresponds to the size of the indexing wheel 48 and the distance between the serrations 50, such that the indexing wheel is interchangeable with a different indexing wheel (not shown) so as to accommodate a different fastener stringer gauge.

Figure 4A:
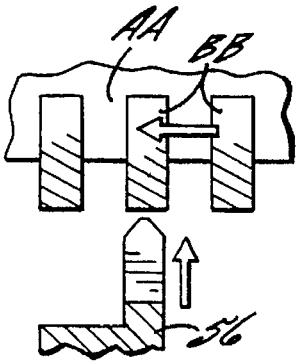
FIGS. 4*a* thorough 4*c* are a top plan view showing the progression of the locator as it is being positioned between adjacent fastener elements of a fastener stringer.
Figure 4B:
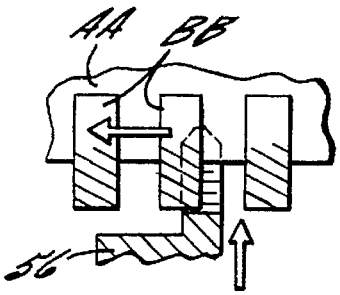
Figure 4C:
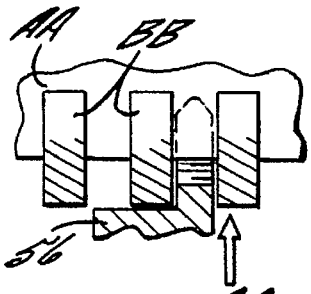
Figure 5:
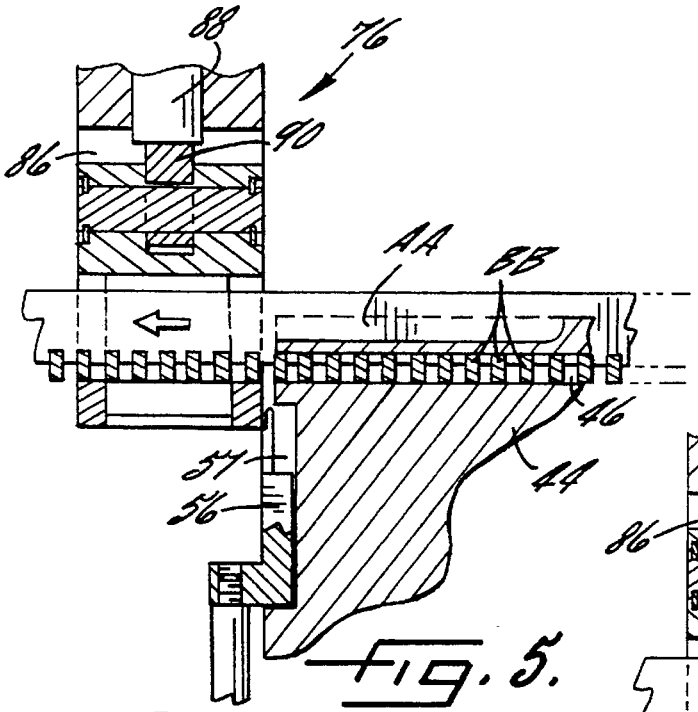
FIG. 5 through FIG. 7 is a side view in partial cross-section illustrating the positioning of the locator between adjacent fastener elements of a fastener stringer corresponding to FIGS. 4*a* through 4*c;*
Figure 6:
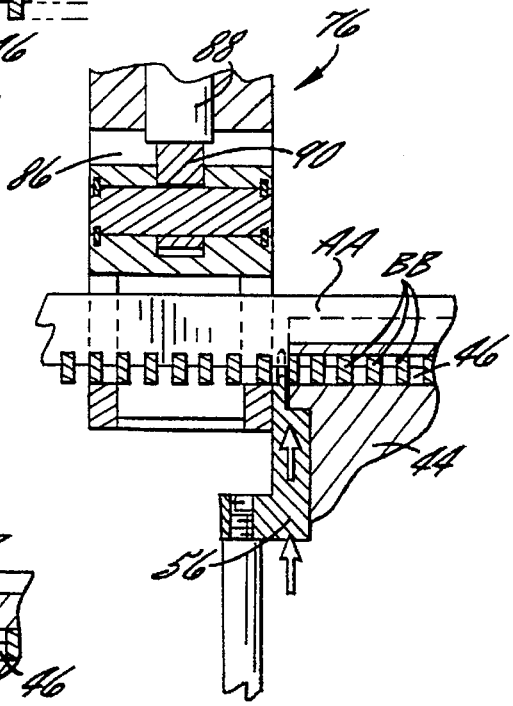
Figure 7:
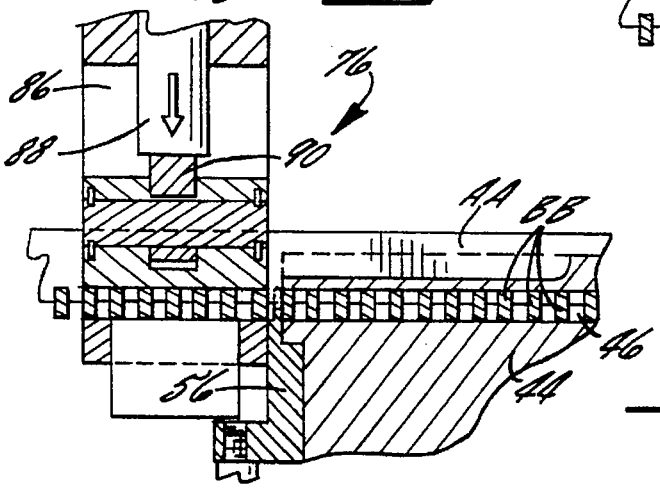

Once the fastener stringers have been advanced the desired predetermined amount by the indexing wheel 48, the clamping device 76 is activated so as to clamp the respective fastener stringers AA downstream of the hinged block 44. As best shown by studying the sequence of events illustrated in FIGS. 4A through 4C, the locator 56 then moves or advances relative to the hinged block so as to be positioned between adjacent fastener elements BB at the downstream end of the gap GG to be formed in the fastener stringers AA. To ensure that the locator 56 fits directly between adjacent fastener elements BB rather than engaging an end or another portion thereof, the indexing wheel 48 advances two pitches, (i.e., one fastener element). Consequently, as shown in FIGS. 4A through 4C, the locator 56 will allow the fastener element to slide by so that the locator can be positioned directly between adjacent fastener elements BB.

As shown in FIGS. 10–14, the locator has a generally T-shaped configuration when seen from the side and a generally rectangular configuration when seen from an end view. The shoulder bolt 98 is connected thereto so as to secure the locator 56 to the hinged block 44. As shown best in FIGS. 10 and 12, each of arms 57 of the locator 56 are slightly offset from the midline of the locator so as to accommodate the stagger of corresponding fastener elements BB located on each of the fastener stringers AA. A notch 59 is located on each of the arms 57. Each notch 59 is intended to receive the fabric portion of each of the fastener stringers AA as the locator 56 is positioned as shown in FIG. 4C.

Having correctly positioned the fastener stringers AA within the hinged block 44, the computer controller 24 activates the air cylinder (not shown) to cause the punch 96 to move downward onto the fastener stringers AA and thereby sever the first two fastener elements BB on the upstream end of the gap GG to be formed. The computer controller 24 then activates the air cylinder 70 associated with the hinged block causing the piston 72 to pivot i.e., angularly displace the hinged block about its pivot pin 55 from the first position to the second position. By so doing, the fastener elements BB positioned under the notch portion 49 of the grooves 46 of the hinged block 44 are stripped or sheared from the respective fastener stringers BB in seriatim. The fastener elements BB located immediately adjacent the gap GG remain undamaged by virtue of the positioning of the locator 56 at the downstream end of the gap and the fact that the first two upstream fastener elements are severed by the punch 96 and because the adjacent upstream fastener elements remain protected within the smaller portion of the groove 46. Consequently, the gap GG formed in the fastener stringers AA has a uniform size and such that the fastener elements BB located immediately adjacent the upstream and downstream of the gap have an opposed relationship as shown in FIG. 2A. The result of having undamaged fastener elements BB located adjacent the gap GG is that the following steps in manufacturing a completed zipper are made easier. For example, because the fastener elements BB are undamaged, the upper and lower stops (not shown) fit easily into position and it is easier to slide the zipper slide into place.

While the hinged bock 44 is in the second position, i.e., after the fastener elements BB have been removed from the fastener stringers AA, an air nozzle 92 connected to and positioned in one of the series of air apertures 106 adjacent the pivot end of the hinged block is activated to blow the fastener elements out of the grooves 46. A basket or catch bag (not shown) may be placed below the hinged block 44 so as to catch the fastener elements BB as they are propelled from the grooves 46.

After the gap GG has been formed, the clamping device 76 releases the fastener stringers AA, and the indexing wheel 48 is again activated so as to advance the fastener stringers until the location of the next area to be gapped is properly positioned. As the fastener stringers AA are advanced downstream of the hinged block, they contact a chain closure device 47, in this case a zipper slider, which returns each of the fastener stringers AA to the original upright position and causes the fastener elements BB of each of the fastener stringers to again become interlocked. The gapped fastener stringers AA are then either wound onto a take-up spool (not shown) or collected in a container QQ for storage prior to movement to subsequent manufacturing stations.

The indexing wheel 48 is one of a series of interchangeable indexing wheels. The size of the indexing wheel 48 and/or the size and spacing of the serations 50 along the periphery thereof are different on each indexing wheel so as to readily accommodate different gauges of fastener stringers AA. Similarly, the hinged block 44 is one of a series of interchangeable hinged blocks. The coordination of the hinged block 44 and the indexing wheel 38 allows the gapping device 22 to readily accommodate a plurality of different gauges of fastener stringers AA. For instance, the length of the notched portion 49 of the hinged block 44 selected determines the length i.e., size of the gap GG to be formed in the fastener stringers AA. By changing hinged blocks 44 allows the operator to change the size of the gap GG. In addition, the internal dimensions of the grooves 46 within a hinged block 44 vary so that different hinged blocks are used with different gauges of fastener stringers. Consequently both the gauge of fastener stringer AA and the size of the gap GG to be formed therein can quickly and easily be changed by removing a cotter pin 67, used to secure the piston 72 to the hinged block 44, and sliding the hinged block off the support 38 and mounting a different hinged block. In addition, the indexing wheel 48, due to the serrations 50 located on its periphery, in cooperation with the stepper motor 54, can advance the fastener stringers AA the desired predetermined distance relative to the hinged block and control the distance between gaps GG. This ability to adjust the distance between gaps GG in the fastener stringers AA is made easier by virtue of the computer controller 24. Accordingly, the cooperation between the indexing wheel 48 and the hinged block 44 provides the gapper device 22 with a great deal of variety in the size of the gaps GG to be formed, the distance between them, and gauge of fastener stringers AA which can be accommodated.

Many modifications and other embodiments of the invention will come to mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. An apparatus for gapping a zipper having a pair of slide fastener stringers, each fastener stringer having a continuous row of fastener elements secured to an edge thereof, the apparatus comprising:

a support having a substantially flat surface for supporting the pair of slide fastener stringers with the fastener elements thereon in generally parallel alignment;

an indexing wheel cooperating with said support, said indexing wheel having a plurality of serration located along a periphery thereof for engaging the fastener elements of the pair of fastener stringers and for incrementally advancing the pair of fastener stringers a predetermined distance along said support;

a hinged block connected to said support upstream of said indexing wheel, said hinged block having a pair of grooves formed along a surface thereof and positioned in the path of the advancing fastener stringers for respectively receiving the fastener stringers in at least the area to be gapped; and pivoting means for pivoting said hinged block relative to said support so that the fastener elements positioned in said pair of grooves of said hinged block are removed seriatim from each of the pair of fastener stringers to thereby form a gap in the slide fastener stringers in the region where the fastener elements are removed.

2. A gapping apparatus according to claim 1 further comprising a locator connected to said hinged block and movable relative thereto for being selectively positioned between adjacent fastener elements so as to locate the fastener stringers relative to said hinged block to thereby prevent damage to fastener elements immediately adjacent the gap and ensure an opposed relationship thereof.

3. The gapping apparatus according to claim 1 further comprising a clamping member mounted to said support for clamping each of the fastener stringers adjacent said hinged block to retain the fastener stringers in position as said hinged block is pivoted relative to said support and the pair of fastener stringers.

4. The gapping apparatus according to claim 1 further comprising a stepper motor cooperating with said indexing wheel for adjustably controlling incremental rotation of said indexing wheel and advancement of the pair of fastener stringers.

5. The gapping apparatus according to claim 1 wherein said plurality of serrations located on said indexing wheel are in spaced relation corresponding to the distance between adjacent fastener elements so as to advance the pair of fastener stringers said predetermined distance.

6. The gapping apparatus according to claim 5 wherein said indexing wheel is one of a set of interchangeable indexing wheels, wherein the diameter of each of said indexing wheels of the set and the spaced relation of said plurality of serrations thereon correspond to the gauge of the fastener stringers to be gapped.

7. The gapping apparatus according to claim 6 wherein said hinged block is one of a set of interchangeable hinged blocks, wherein the size of each of said hinged blocks of the set corresponds to the gauge of the fastener stringers to be gapped so as to obtain said predetermined distance between gaps on the corresponding pair of fastener stringers, wherein each of said group of hinged blocks is interchangeably useable with said correspondingly sized indexing wheel.

8. The gapping apparatus according to claim 1 wherein said pivoting means comprises a cylinder having a reciprocating piston connected between said hinged block and said support for pivoting said hinged block between a first generally horizontal position and a second position angularly displaced from said first position.

9. The gapping apparatus according to claim 1 further comprising a chain splitter connected to said support upstream of said hinged block for separating the pair of fastener stringers from interengagement with one another prior to the fastener stringers being received by said hinged block.

10. The gapping apparatus according to claim 1 further comprising a punch cooperating with said hinged block for removing at least one of the fastener elements from each of the fastener stringers in the region where the fastener elements are to be removed.

11. An apparatus for gapping a zipper having a pair of slide fastener stringers in interlocking arrangement, each fastener stringer having a continuous row of fasteners elements secured to an edge thereof, the apparatus comprising:

a support having a substantially flat surface for supporting the pair of fastener stringers thereon in generally parallel alignment;

an indexing wheel cooperating with said support, said indexing wheel having a plurality of serrations located along a periphery thereof for engaging the fastener elements of the pair of fastener stringers and for incrementally advancing the pair of fastener stringers a predetermined distance along said support;

a chain splitter connected to said support in the path of the advancing fastener stringers for separating the interlocking fastener elements so as to separate the pair of fastener stringers;

a hinged block connected to said support upstream of said indexing wheel, said hinged block having a pair of grooves formed along a surface thereof and positioned in the path of the advancing fastener stringers for respectively receiving the fastener stringers in at least the area to be gapped;

a locator connected to said hinged block and movable relative thereto for being positioned between adjacent fastener elements so as to locate the pair of fastener stringers in a predetermined position relative to said hinged block; and pivoting means for pivoting said hinged block relative to said support so that the fastener elements positioned in said pair of grooves of said hinged block are removed seriatim from each of the pair of fastener stringers and to ensure that the fastener elements immediately adjacent a formed gap are undamaged and have an opposed relationship.

12. The gapping apparatus according to claim 11 further comprising a stepper motor cooperating with said indexing wheel for adjustably controlling incremental rotation of said indexing wheel and advancement of the pair of fastener stringers.

13. The gapping apparatus according to claim 11 wherein said plurality of serrations on said indexing wheel are located in spaced relation corresponding to the distance between adjacent fastener elements so as to advance the pair of fastener stringers said predetermined distance.

14. The gapping apparatus according to claim 11 wherein said indexing wheel comprises one of a set of interchangeable indexing wheels, wherein the diameter of each of said indexing wheels of the set and the spaced relation of said plurality of serrations correspond to the gauge of the fastener stringers to be gapped.

15. The gapping apparatus according to claim 14 wherein said hinged block comprises one of a set of interchangeable hinged blocks, wherein the size of each of said hinged blocks of the set corresponds to the gauge of the fastener stringers to be gapped so as to obtain said predetermined distance between gaps on the pair of fastener stringers, wherein each of said group of hinged blocks is interchangeably useable with said correspondingly sized indexing wheel.

16. The gapping apparatus according to claim 11 further comprising a punch cooperating with said hinged block for removing at least one of the fastener elements from each of the fastener stringers in the region where the fastener elements are to be removed.

17. A process of gapping a zipper having a pair of slide fastener stringers, each fastener stringer having a continuous row of fasteners elements secured to an edge thereof, the process steps comprising:

guiding each of the respective fastener stringers into corresponding grooves formed in a hinged block in at least the area to be gapped;

engaging the fastener elements of the pair of fastener stringers by an indexing wheel having a plurality serrations located in spaced relation around a periphery thereof;

advancing incrementally the pair of fastener stringers with said indexing wheel a predetermined distance along said support so as to position the fastener stringers into said grooves of said hinged block;

positioning a locator connected to said hinged block between adjacent fastener elements to locate the pair of fastener stringers in a predetermined position relative to said hinged block; and pivotally moving said hinged block relative to said support so that the fastener elements are removed seriatim from each of the pair of fastener stringers so as to ensure that fastener elements immediately adjacent a formed gap are undamaged and have an opposed relationship.

18. A process according to claim 17 further including the step of separating the pair of fastener stringers from interengagement with one another prior to the fastener stringers being guided into said hinged block.

19. A process according to claim 17 further including the step of clamping at least a portion of each of the pair of fastener stringers to said support adjacent said hinged block to prevent movement thereof.

20. A process according to claim 17 further including the step of activating an air hose for blowing away remnants of the fastener elements once they have been stripped from each of the pair of fastener stringers.

21. A process according to claim 17 further comprising the step of replacing said hinged block with one of a plurality of interchangeable hinged blocks sized to accommodate different gauges of fastener elements.

22. A process according to claim 21 further comprising replacing said indexing wheel with one of a plurality of interchangeable indexing wheels sized to accommodate different gauges of fastener elements.

23. A process according to claim 17 further comprising the step of removing at least one fastener element from each of the fastener stringers by means of a punch prior to pivotally moving said hinged block relative to said support.

24. A process of gapping a zipper having a pair slide fastener stringers, each fastener stringer having a continuous row of fasteners elements secured to an edge thereof, the process steps comprising:

serially engaging a predetermined number of fastener elements by a plurality of serations located on a periphery of an indexing wheel and incrementally advancing the pair of fastener stringers a predetermined distance along a surface of a support thereby positioning the fastener stringers into grooves formed in a hinged block in at least the area to be gapped;

positioning a locator connected to said hinged block between adjacent fastener elements to thereby locate a downstream end of the gap;

clamping at least a portion of each of the pair of fastener stringers to said support adjacent said hinged block for preventing movement thereof;

moving a punch relative to said support so as to remove at least one fastener element from each of the fastener stringers; and moving said hinged block relative to said support so that the fastener elements are removed seriatim from each of the pair of fastener stringers so as to ensure that fastener elements immediately adjacent a formed gap are undamaged and have an opposed relationship.

* * * * *